5/6/86 XR 4,586,938

United States Patent [19]

Cornelissen

[11] Patent Number: 4,586,938

[45] Date of Patent: May 6, 1986

[54] PROCESS FOR CONDITIONING NATURAL GAS FOR PIPELINE TRANSPORT

[75] Inventor: Anton E. Cornelissen, Amsterdam, Netherlands

[73] Assignee: Shell Oil Company, Houston, Tex.

[21] Appl. No.: 653,000

[22] Filed: Sep. 21, 1984

[30] Foreign Application Priority Data

Oct. 5, 1983 [GB] United Kingdom ..... 8326665

[51] Int. Cl.[4] ..... C10K 1/00; B01D 53/14

[52] U.S. Cl. ..... 48/196 R; 48/190; 55/29; 137/3; 137/13

[58] Field of Search ..... 48/190, 196 R; 55/29; 137/3, 13

[56] References Cited

U.S. PATENT DOCUMENTS

| | | | |
|---|---|---|---|
| 2,966,402 | 12/1960 | Hasche | 48/190 |
| 3,495,380 | 2/1970 | Reman et al. | 48/190 |
| 3,527,585 | 9/1970 | Ungerleider | 48/196 R |
| 3,644,107 | 2/1972 | Clark | 48/190 |
| 3,689,237 | 9/1972 | Stark et al. | 48/196 R |
| 3,788,825 | 1/1974 | Arenson | 48/196 R |
| 4,213,476 | 7/1980 | Bresie et al. | 48/190 |
| 4,279,628 | 7/1981 | Wymer et al. | 55/29 |

FOREIGN PATENT DOCUMENTS

| | | | |
|---|---|---|---|
| 2026534 | 2/1980 | United Kingdom | 55/29 |

*Primary Examiner*—S. Leon Bashore
*Assistant Examiner*—K. M. Hastings

[57] ABSTRACT

A process for conditioning a natural gas stream containing liquid hydrocarbons, for pipeline transport, which process comprises separating the natural gas stream into a hydrocarbon liquid component and a hydrocarbon gaseous component, absorbing water and water vapor from said gaseous component, optionally removing free water from the liquid component, heating the liquid component and allowing the water still present to dissolve in the liquid component and atomizing the heated liquid component with dissolved water into the treated gaseous component for transport through a pipeline.

6 Claims, No Drawings

PROCESS FOR CONDITIONING NATURAL GAS FOR PIPELINE TRANSPORT

BACKGROUND OF THE INVENTION

The present invention relates to a process for conditioning natural gas containing liquid hydrocarbons, for pipeline transport.

Natural gas can be classified into two broad categories on the basis of chemical composition. These categories are natural gas, which contains economically recoverable amounts of condensable hydrocarbons, and natural gas not containing economically recoverable amounts of condensable hydrocarbons. The present invention deals with conditioning natural gas of the first category comprising gaseous hydrocarbons and liquid hydrocarbons.

On producing natural gas in the field, heavier hydrocarbon components in the gas may condense together with water as a result of a drop in temperature of the gas as it is transferred from a subsurface well to a surface location. Although the presence of water vapor is not particularly objectionable, water in the liquid or solid state can create problems. Water in the liquid state tends to accelerate corrosion of the pipeline system through which the gas is transported, especially when considerable amounts of acidic components, such as carbon dioxide, are present in the gas. Solid hydrates can greatly restrict or actually even stop the flow of gas through a pipeline.

In order to eliminate or at least to minimize the above negative effects in natural gas pipeline transport, it is normal practice to reduce the water content of the raw natural gas to such a concentration that the water dewpoint temperature of the gas is somewhat lower than the lowest temperature to be encountered in the pipeline system through which the gas will be transported. For dehydrating a natural gas stream it is known to separate the production stream into a condensate phase and a gas phase, whereafter the water and water vapor present in the gas phase are removed therefrom by scrubbing the gas under pressure with a suitable absorbent or desiccant, such as diethylene and triethylene glycol, having an affinity for water. The bulk of the water in the condensate phase is normally separated by gravity settling. However, the settling tends to leave the dissolved water and water droplets smaller than about 50 micrometers suspended in the hydrocarbon condensate.

Since the processing of a natural gas stream is usually handled in plants which are located at considerable distances from the wells producing the natural gas, it is a common practice to transport both condensate and vapor phases through a single pipeline to the processing plants. By feeding the only partially dried condensate into a transport pipeline together with dry gas, the water still present in the condensate will start to evaporate into the gas either until no water is left in the condensate, or until the gas is saturated with water vapor at the prevailing temperature, depending on the gas/condensate feed ratio. In the latter case the condensate has to be further dried, prior to being supplied into the pipeline since otherwise, condensed water formed upon decrease of the gas temperature, e.g. because of the gradual expansion during pipeline transport, will wet the wall of the pipeline, and may result in corrosion, particularly if the gas stream contains a substantial percentage of acidic components. If required in view of the above considerations, the condensate may be further dried by bringing it in intimate contact with dry gas, such as already dried natural gas, whereby the water in the condensate is stripped therefrom by the gas. This process, however, requires additional equipment, such as a stripping gas absorber.

The present invention deals with the situation that the gas/condensate feed ratio is so high that the dried gas can strip out or "absorb" all the water initially present in the wet condensate without exceeding the dewpoint specification. This means that if dried gas and wet condensate are fed together into a pipeline, there is no risk of corrosion or the formation of hydrates after the water evaporation process is complete. Corrosion and/or flow hampering problems may however, occur in the first part of the pipeline when the water in the condensate is still evaporating into the gas. The total pipeline length required for complete evaporation of the water in the condensate depends on the gas/condensate ratio, the water/condensate ratio upon introduction into the pipeline, the gas/condensate interfacial area in the pipeline and the temperature prevailing during the evaporation.

The evaporation of water from condensate is a rather longlasting process since physically dissolved water evaporates from the condensate, and due to the so decreased water concentration in the condensate, water droplets physically dissolve in the condensate. On account of the poor solubility of water in condensate the first step of the evaporation process proceeds very slowly. During the process the rate of evaporation further decreases for two reasons, viz. decreasing interfacial area dropsize, and increasing water vapor pressure in the gas.

Taking further into account the rather high flow rates—normally about 5–10 m/sec for the gas and about 3–5 m/sec for the condensate—in gas transport pipelines, it will be understood that the length of the pipeline necessary for evaporation of the water is in the order of magnitude of several kilometers. This pipeline length may be somewhat shortened by spraying atomized condensate into the gas flow instead of just feeding the condensate as a thick stream into the gas pipeline as normally practiced. Atomization of the condensate into the gas flow results in a considerable increase of the interfacial area between the condensate and the gas, which advantageously influences the rate of evaporation of dissolved water from the condensate into the gas phase. Since the solubility of water in condensate remains poor the total rate of evaporation will be such that a considerable length of pipeline remains required.

The object of the present invention is to substantially eliminate the risk of corrosion during transport of wet natural gas in the first part of a gas pipeline where the water evaporation still proceeds.

SUMMARY OF THE INVENTION

The present invention provides a process for conditioning a natural gas stream for pipeline transport, which process comprises separating the natural gas stream into a hydrocarbon liquid component or condensate and a hydrocarbon gaseous component, absorbing water and water vapor from the separated gaseous component, optionally removing some free or undissolved water from the separated liquid component, heating the separated liquid component to cause the water still present to dissolve in the liquid hydrocarbon, and atomizing the heated water-containing liquid hydrocarbon into the treated gaseous component for transport through a pipeline.

DESCRIPTION OF THE INVENTION

Since in the process according to the present invention the water in the hydrocarbon liquid component or condensate, hereinafter called condensate, is first dissolved in said condensate prior to introduction of the liquid into the transport pipeline, the rate of evaporation in the pipeline is caused to be rather large, as it is no longer restricted by the rate of dissolving of the water in the condensate. The heating step in the present process has a further effect in that the water in the condensate is homogeneously divided so that, after the atomization, the condensate droplets contains substantially equal quantities of water.

The positive effect of the process according to the invention may be further explained with the following Example. Let us consider a natural gas stream consisting of gas and condensate, which steam contains 1140 ppmw water. Let us further assume that the condensate has such a composition that at a prevailing temperature of 20° C. 140 ppmw water will be dissolved in the condensate. The condensate is heated to a temperature such that the free water is fully dissolved in the condensate. The temperature at which the condensate should be heated depends on the composition of the condensate, which in its turn determines the water-solubility and the total quantity of free water initially present in the condensate.

The heated condensate is subsequently atomized to droplets having a diameter of about 50 micrometers. The volume of each droplet is then about $65\times10^{-15}m^3$ and at a density of the condensate of say 660 $kg/m^3$, the weight of one droplet is about $42.9\times10^{-12}$ kg. Upon atomization of the heated condensate into the dried gaseous component of the gas stream, a major part of the dissolved water will evaporate into the gas.

However, even if we neglect this effect completely, subsequent cooling of the condensate droplets to the initial temperature of 20° C. will cause separation of 1000 ppmw water from the condensate, while only 140 ppmw water remains in dissolved condition in the condensate. From each droplet of condensate $42.9\times10^{-15}$ kg is separated as free water. In the most unfavorable case, this water in each droplet of condensate separates as one droplet. The diameter of a so formed water droplet will be 4.3 micrometers. If the water in a droplet of condensate separates as a plurality of droplets, these droplets will then be even smaller than 4.3 micrometers.

In the above example, the evaporation of water into the gas phase has not been taken into account. The evaporation has however a favorable effect on the amount, and hence on the droplet size of the separated water. Therefore, remaining water droplets, if any still present, will in practice have an average diameter which is far below the average diameter which is far below the above calculated one, since part of the water in the condensate will already have been evaporated prior to the separation of free water in the condensate droplets.

Even in the above worst case, water droplets are formed which are so small that they substantially remain in suspension due to the Brownian Movement of the particles. This means that even if the condensate settles down on the bottom of the transport pipeline, due to, for example, stagnation in the pipeline, the water droplets remain in suspension and will not coalesce on the bottom part of the pipeline wall. The water in the condensate does therefore no longer give rise to problems induced by corrosion or the formation of hydrates.

The condensate should preferably be atomized to such an extent that the droplets of condensate contains an amount of water which can form in the worst case a droplet with a diameter of at most about 4 to 5 micrometers which remains in suspension by the Brownian Movement. In general, the above requirement will be fulfilled with condensate droplets having a maximum diameter of about 50 micrometers. Droplets of such a diameter may easily be generated by commercially available atomizers of, for example, the pressure type.

In the above process according to the invention is particularly suitable for offshore locations where the available space for equipment is restricted. Heating of the condensate may be accomplished by simple, space-saving equipment, such as heating coils. Although the problem of corrosion of the pipeline may also be overcome by completely drying the condensate, as discussed in the introductory part of the specification, this method is less attractive in view of the necessary drying equipment, formed by, for example, huge stripping towers. The water and water vapor in the gaseous component of the natural gas stream may be removed therefrom by contacting the gas with a desiccant, for example, diethylene or triethylene glycol. If the liquid component should be partially dried for meeting the dewpoint specification, this may be accomplished in a simple manner by gravity settling.

To promote the rate of dissolving of the water in the condensate, it is advantageous to heat the condensate to a temperature substantially above the temperature at which the total quantity of water can be dissolved in the condensate.

The gaseous component may be completely dried. From an economical point of view it is, however, advisable to dry the gaseous component only to such an extent that during pipeline transport the actual temperature of the natural gas stream remains substantially above the dewpoint temperature of the gas stream.

What is claimed is:

1. A process for conditioning a stream of natural gas which contains hydrocarbons and water for pipeline transport, which process comprises:

separating the natural gas stream into a water containing hydrocarbon liquid component and a water containing hydrocarbon gaseous component;

absorbing water and water vapor from the separated hydrocarbon gaseous component and heating the separated water containing hydrocarbon liquid component to cause the water present to dissolve in the liquid hydrocarbon component; and atomizing the heated hydrocarbon liquid component containing the dissolved water into small droplets that substantially remain in suspension into the treated gaseous component for transport through a pipeline.

2. The process as claimed in claim 1, wherein the heated hydrocarbon liquid component is atomized to form droplets having an average diameter of at most about 50 micrometers.

3. The process as claimed in claim 1, wherein water is removed from the separated water containing hydrocarbon liquid component via gravity settling.

4. The process as claimed in claim 1, wherein the separated water containing hydrocarbon liquid component is heated to a temperature at least above the temperature required for dissolving the water present.

5. The process as claimed in claim 1, wherein the separated hydrocarbon gaseous component is contacted with a liquid absorbent for absorbing water and water vapor to at least such an extent that the dewpoint temperature of the gas stream formed by atomizing said heated liquid hydrocarbon component into said treated gaseous component is substantially below the temperature during pipeline transport.

6. The process as claimed in claim 1, wherein the hydrocarbon gas to water ratio of the natural gas stream is sufficient to cause the gas to absorb all of the water initially present in that stream.

* * * * *